US006216506B1

(12) United States Patent
Stevens et al.

(10) Patent No.: US 6,216,506 B1
(45) Date of Patent: Apr. 17, 2001

(54) DOUBLE-DRAFT WIRE DRAWING AND COLLECTION MACHINE WITH TENSION-SENSITIVE SPEED CONTROL

(75) Inventors: John Stevens, Cucamonga; Allen D. Anderson, Fontana, both of CA (US)

(73) Assignee: Macbee Engineering Corp., Rancho Cucamonga, CA (US)

( * ) Notice: Subject to any disclaimer, the term of this patent is extended or adjusted under 35 U.S.C. 154(b) by 0 days.

(21) Appl. No.: 09/412,941

(22) Filed: Oct. 5, 1999

(51) Int. Cl.[7] ..... B21C 1/10; B21C 1/12

(52) U.S. Cl. ..... 72/19.2; 72/279; 72/280; 72/288

(58) Field of Search ..... 72/19.2, 18.4, 72/16.6, 280, 279, 288

(56) References Cited

U.S. PATENT DOCUMENTS 1,865,781 * 7/1932 Najarian ..... 72/280
3,177,690 * 4/1965 McLlvried ..... 72/280
4,045,992 * 9/1977 Griffiths ..... 72/279
4,754,633 * 7/1988 Glover ..... 72/288

FOREIGN PATENT DOCUMENTS

718732 * 9/1965 (CA) ..... 72/280
21417 * 1/1987 (JP) ..... 72/280

* cited by examiner

*Primary Examiner*—Daniel C. Crane
(74) *Attorney, Agent, or Firm*—James S. Tak

(57) ABSTRACT

A double-draft continuous wire drawing and collection machine having first and second reduction dies for drawing wire in succession. A rotary advancing block driven by a variable-speed first motor draws wire rod through the first reduction die, and a rotary flyer mechanism driven by a second motor draws wire through the second reduction die as it coils wire on a stationary block. A tension control arm and rheostat regulate the speed of the first motor based on wire tension differentials detected between the rotary advancing block and the second reduction die, in order to maintain constant wire tension in that wire segment.

5 Claims, 2 Drawing Sheets

DOUBLE-DRAFT WIRE DRAWING AND COLLECTION MACHINE WITH TENSION-SENSITIVE SPEED CONTROL

BACKGROUND OF THE INVENTION

The field of the invention generally pertains to wire drawing and collection machines. The invention relates more particularly to a double-draft wire drawing and collection machine with tension-sensitive speed control.

Various types of wire drawing machines have been developed to mass produce large quantities of wire in a wide variety of gauges. In particular, continuous wire drawing machines have greatly improved wire production by incorporating consecutively arranged multiple reduction dies. This increases the number of passes or drafts experienced by wire rod, and consequently enables greater wire gauge reductions.

For example, in U.S. Pat. No. 2,272,195 an accumulating-type continuous wire drawing machine is shown having multiple reduction dies arranged in series with corresponding advancing blocks or drums positioned to successively draw wire through the respective dies. Each block is driven by a variable-speed motor controlled by an independent speed control rheostat. The block furthest downstream, known as the finishing or "master" block 20, is preset to run at a constant speed, while the speed of each block preceding the master block can be independently regulated to compensate for wire elongation, as well as to control the amount of accumulation on each block. In the '195 patent, these block speeds are manually adjusted by an operator observing the motion of guide rings 45, 45*a* and chains 46, 46*a* slidably mounted on each respective block.

However, most continuous wire drawing machines in operation today, especially non-accumulating type machines, utilize tension control arms, i.e. dancers to automatically and independently regulate the speed of corresponding motors and advancing blocks. They function to maintain constant wire tension and prevent wire breakage by detecting wire tension differentials between reduction dies. They are typically connected to rheostats which generate and transmit proportional electrical control signals to the motor of the corresponding advancing block or drum. In this manner a master block having a preset speed can reference the speeds of each of the preceding advancing blocks, and prevent wire breakage between reduction dies.

Additionally, various types of wire collection machines or "take-up" equipment have been developed to support wire drawing machines in the final packaging/bundling stage of wire production. In particular, wire collection machines known as "dead blocks" have been widely used to coil and collect wire into bundles. They do so by means of a rotary "flyer" mechanism which operates to coil or wrap wire around a stationary block or drum. Due to a taper on the stationary block, wire wrapped in this manner continues to move outward on the stationary block while maintaining sufficient tension to pull evenly, until the wire falls into a finished wire heap. The advantage of this is that wire can be coiled and removed with complete safety, regardless of coil speeds, and without interrupting the operation of the drawing machine.

In many cases an additional die is secured to the flyer to simultaneously draw and coil wire on the stationary block. This enhances the utility of the dead block by complementing wire drawing machines to produce even greater wire reductions. Moreover, because of their combined wire drawing and collection capabilities, these dead block machines can also be utilized as stand-alone production units capable of directly drawing wire rod from a spool, and not merely as ancillary equipment to wire drawing machines. One example of a dead block machine used as a stand-alone unit is a fixed double-deck dead block having a single block with two deck surfaces. While double-deck dead blocks operate to draw and collect wire as a single production unit, they typically have relatively slow operating speeds, and have a limited range of wire gauge reduction. Additionally, because double-deck dead block machines are driven by a single motor they cannot take advantage of the tension control arm feature described above.

BRIEF SUMMARY OF THE INVENTION

It is an object of the present invention to provide a simple and efficient double-draft wire drawing and collection machine capable of continuous and synchronized drawing and collection of wire.

It is a further object of the present invention to provide a simple and efficient double-draft wire drawing and collection machine having two wire drawing blocks, each driven by an independent motor.

It is a still further object of the present invention to provide a simple and efficient double-draft dead block machine for use as a stand-alone unit in wire drawing and collection.

The present invention is for a double-draft wire drawing and collection machine generally having a frame supported on a surface. The frame supports a first reduction die, and a rotary advancing block driven by a variable-speed first motor for drawing wire through the first reduction die. Additionally, a stationary block having a central axis for temporally collecting wire is also supported on the frame downstream from the rotary advancing block. A rotary means for coiling wire on the stationary block having an axis of rotation coaxial with the central axis is driven by a second motor at a constant speed to collect wire on the stationary block. A second reduction die which is secured to a radially distal point from the axis of rotation further reduces the wire in the process of collecting wire. Finally, the wire drawing and collection machine has means for regulating the speed of the rotary advancing block which includes a tension control arm for sensing wire tension differentials, and means for varying the speed of the first motor depending on the position of the tension control arm, in order to maintain constant wire tension between the rotary advancing block and the second reduction die.

DETAILED DESCRIPTION OF THE PREFERRED EMBODIMENTS

Figure 1:
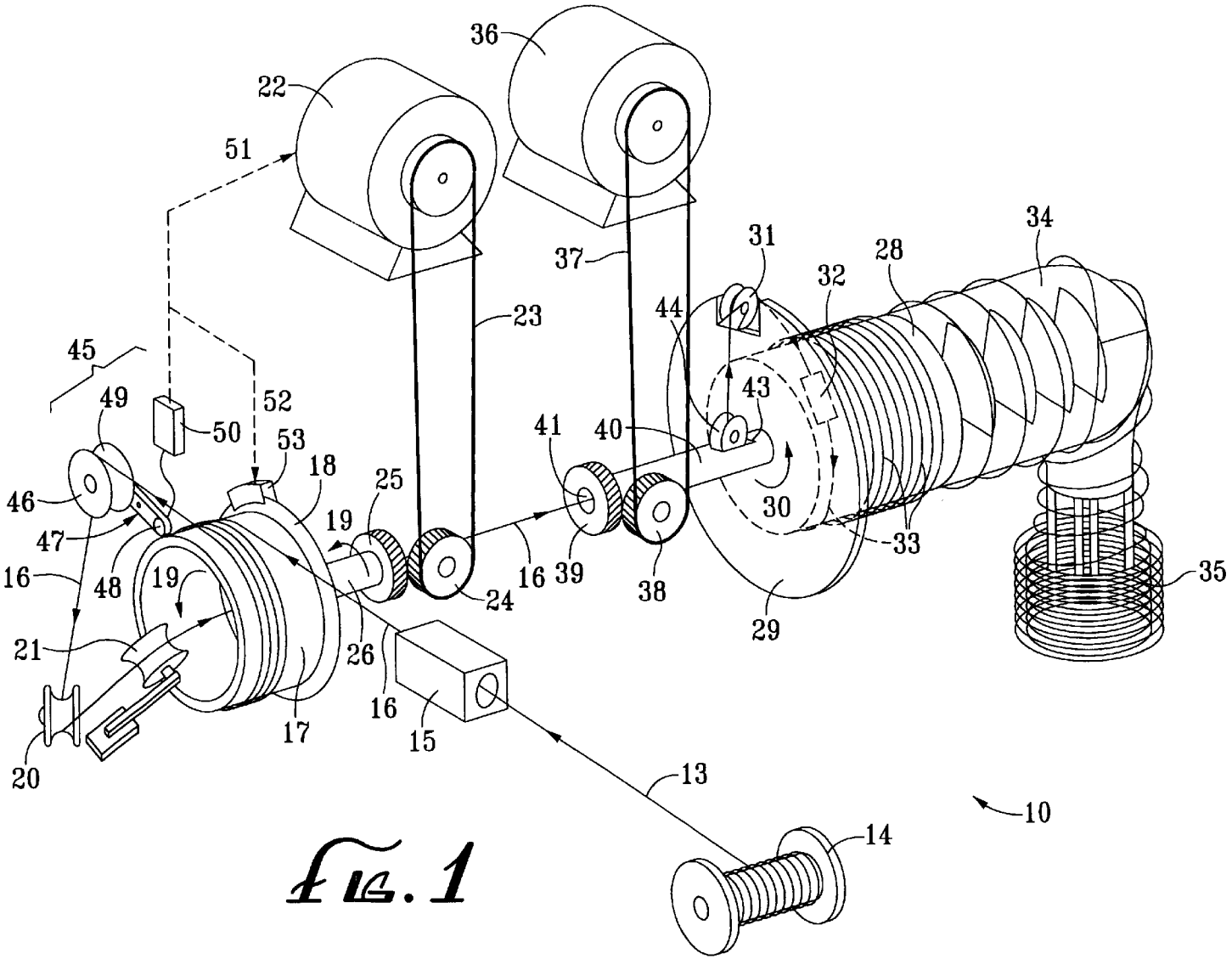
FIG. 1 is a perspective view of a preferred embodiment of the double-draft continuous wire drawing and collection machine absent the frame, illustrating the directional flow of wire.
Figure 2:
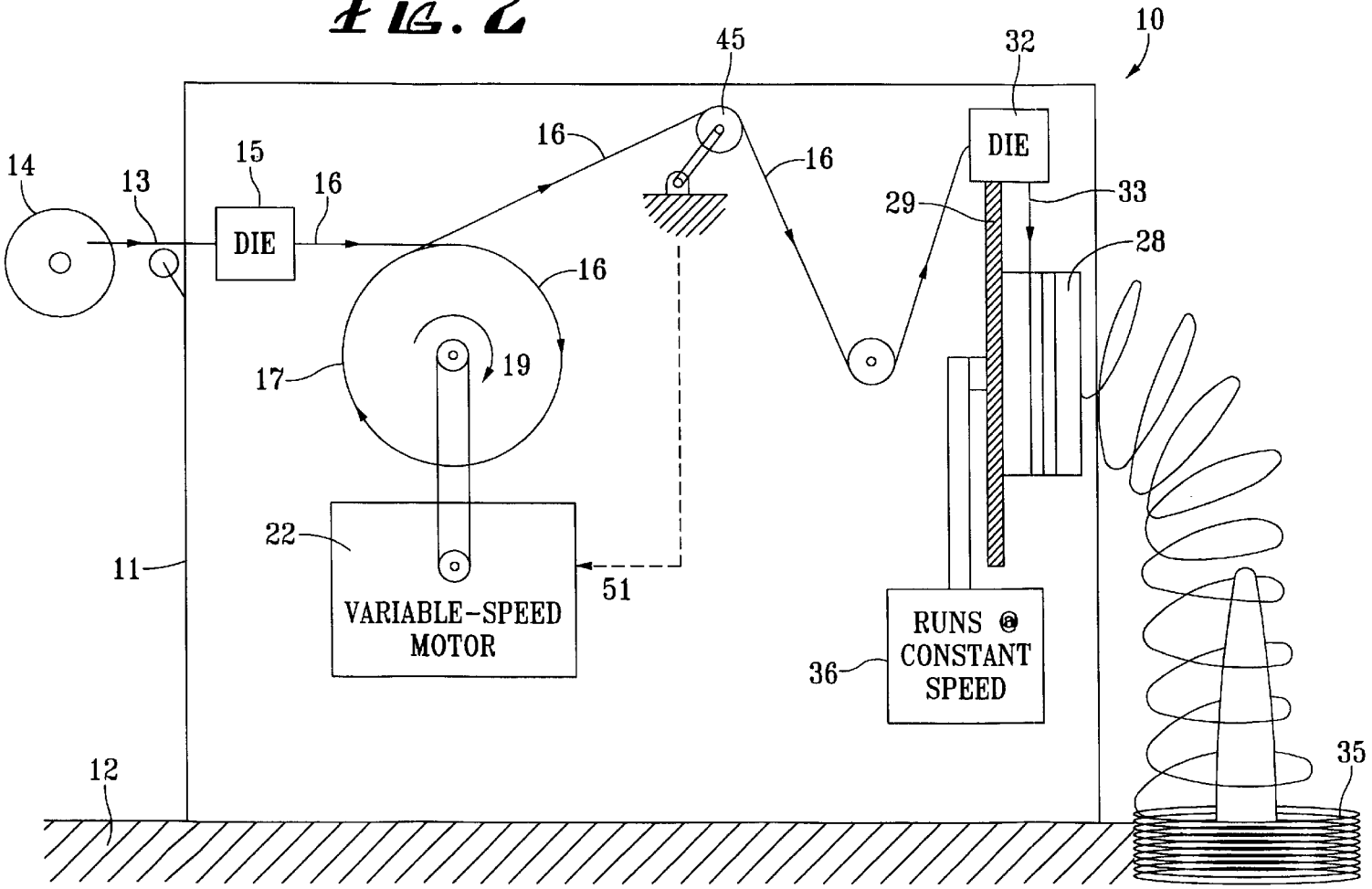
FIG. 2 is a schematic side view of the double draft wire drawing and collection machine illustrating the principle operative features.

Referring now to the drawings, FIGS. 1 and 2 show the double-draft wire drawing and collection machine with tension-sensitive speed control, generally indicated by reference character 10. FIG. 2 is a schematic side view of the double-draft wire drawing and collection machine illustrating the relationship of the machines principle operative features. As can be seen in FIG. 2, the machine 10 includes a frame 11 upon which all other components and elements are supported on or secured to. The frame 11 itself is supported on a surface 12, such as the floor of a wire production plant. Preferably, the frame 11 has access panels (not shown) for servicing the machine 10 during routine maintenance. Additionally, FIG. 1 shows a perspective view of a preferred embodiment of the wire drawing and collection machine 10, absent the frame 11. The frame 11 has been removed to detail the internal operation of the machine 10, and to illustrate the directional flow of wire.

As can be seen in FIGS. 1 and 2, the machine 10 includes a first reduction die 15 suitably mounted and supported by the frame 11. The first reduction die 15 is preferably a conventional wire reduction die having a construction for drawing wires at a desired percentage reduction. And the wire material to be drawn is preferably undrawn wire rod 13 from a pay-off spool 14, but is not limited only to such. Wire rod 13 enters the first reduction die 15 where it undergoes a reduction in its cross-sectional area, and exits as once-drafted wire 16.

As shown in FIGS. 1 and 2, wire rod 13 is drawn through the first reduction die 15 by means of a rotary advancing block 17 also supported on the frame 11 by suitable bearings and located downstream from the first reduction die 15. The wire 16 is wrapped several times around the rotary advancing block 17 which preferably has a cylindrical configuration with a horizontal axis of rotation. And preferably still, the rotary advancing block 17 has a ring shaped lip 18 for decelerating the rotary advancing block 17 by means of a brake 53. The rotary advancing block 17 is driven by a variable-speed first motor 22, which is preferably a variable-speed DC electric motor. As can be seen in FIG. 1, a preferred embodiment of the machine 10 includes a drive train having a first drive belt 23, and a transmission gearbox (not shown) which transfers power to the rotary advancing block 22 via a first drive shaft 26. In FIG. 1, the transmission gearbox is illustratively represented by a first drive gear 24 and a first shaft gear 25 which engages the first drive gear 24 and drives the first drive shaft 26 and rotary advancing block 17 in the rotational direction indicated by reference character 19. However, other transmission configurations are contemplated as understood and practiced in the relevant art.

Downstream from the rotary advancing block 16 is means for regulating the speed of the rotary advancing block 17, generally indicated by reference character 45. The means for regulating 45 operates to detect tension differentials by monitoring the magnitude of forces acting at right angles to the direction of wire travel. The means for regulating 45 includes, a tension control arm 47 or dancer 47 for sensing wire tension differentials between the rotary advancing block 17 and the second reduction die 32 (see FIG. 1). The tension control arm 47 has a first end 48 pivotally secured to the frame 11, and a second end 49 opposite the first end 48 having a sheave 46. As wire 16 passes around the sheave 46, tension differentials in the wire 16 activates movement of the tension control arm 47.

The means for regulating 45 also includes means for varying 50 the speed of the first motor 22 dependent on the position of the tension control arm 47 as determined by the wire 16 being withdrawn from the rotary advancing block 17. Preferably the means for varying 50 is a rheostat which generates and transmits electrical control signals 51, 52 for accelerating the first motor 22 and decelerating the rotary advancing block 17, respectively. The electrical control signal 52 for decelerating the rotary advancing block 17 actuates the brake 53 on the ring shaped lip 18 of the rotary advancing block 17. The electrical control signals 51, 52 are proportional to the position of the tension control arm 47, to accelerate or decelerate the rotary advancing block 17, and thereby maintain constant wire tension.

In this manner, wire rod 13 is drawn through the first reduction die 15 by the rotary advancing block 17. The wire 16 then passes around the sheave 46 of the tension control arm 47 and around sheaves 20 and 21 before traveling to the second reduction die 32. In a preferred embodiment, as shown in FIG. 1, wire passage from the rotary advancing block 17 to the second reduction die 32 is through the hollow centers of the rotary advancing block 17 and the first and second drive shafts 26, 40. As shown in FIG. 1, the sheaves 46, 20, and 21 operate to redirect the wire 16 being withdrawn from the rotary advancing block 17 through the hollow center of the rotary advancing block 17.

Downstream from the means for regulating 45 and after the wire 16 exits the first drive shaft 26, it enters the second drive shaft 40 via inlet 41. The second drive shaft 40 functions to drive a flyer 29 preferably in the shape of a wheel 29 or arm. Similar to the rotary advancing block 17, the flyer 29 is independently driven by a second motor 36, which is preferably a variable-speed DC electric motor. However, unlike the first motor 22, the second motor 36 is preset to run at a constant speed. Consequently, the flyer 29 also rotates at a constant wire drawing and coiling speed. And preferably, the second motor 36 drives the flyer 29 by means of a second drive train having a second drive belt 37, and a transmission gearbox (not shown) which transfers power to the flyer 29 via the second drive shaft 40. In FIG. 1, the transmission gearbox of the second drive train is illustratively represented by a second drive gear 38 and a second shaft gear 39 which engages the second drive gear 38 and drives the second drive shaft 40 and flyer 29 in a rotational direction indicated by reference character 30.

In this manner, the flyer 29 rotatably coils wire temporarily onto a stationary block 28, also known as a "dead block" which is suitably and fixedly supported by the frame 11. The stationary block 28 preferably has a tapered cylindrical configuration with a horizontally oriented center axis, and the flyer 29 has an axis of rotation coaxial with the center axis of the stationary block 28. The wire 16 is directed out of the second drive shaft 40 through an opening 43 by a sheave 44. Preferably, the wire 16 is then directed to a sheave 31 affixed to the flyer 29 which redirects the wire 16 into a second reduction die 32 also affixed to the flyer 29.

Similar to the first reduction die 15, the second reduction die 32 is preferably a conventional wire reduction die having a construction for drawing wires at a further desired percentage reduction. The once-drawn wire 16 enters the second reduction die 32 where it undergoes a further reduction in its cross-sectional area, and exits as twice-drafted wire 33. Thus wire 16 is drawn through the second reduction die 32 by the rotational movement of the flyer 29 and coils the twice-drafted wire 33 onto the stationary block 28.

As the twice-drafted wire 33 is collected on the stationary block 28, the block taper of the stationary block 28 allows the wire 33 to adjust its own tension in order to pull evenly, and to feed Out on the stationary block 28 without excessive slippage or crossovers. Thus the wire 33 travels further out on the stationary block 28 where the wire 33 can be collected in a coiled bundle. And as can be seen in FIG. 1, an extended horn 34 is preferably utilized as an extension of the stationary block 28 whereby wire loops may fall and collect in a coiled wire heap 35 ready for transport.

The present embodiments of this invention are thus to be considered in all respects as illustrative and not restrictive;

the scope of the invention being indicated by the appended claims rather than by the foregoing description. All changes which come within the meaning and range of equivalency of the claims are intended to be embraced therein.

We claim:

1. A machine for continuous wire drawing and collection comprising:

a frame supported on a surface;

a first reduction die supported on said frame;

a variable-speed first motor;

a rotary advancing block for drawing wire through said first reduction die, said rotary advancing block supported on said frame downstream of said first reduction die and driven by said variable-speed first motor;

a stationary block for temporally collecting wire thereon, said stationary block having a central axis and supported on said frame downstream of said rotary advancing block;

a second motor;

rotary means for coiling wire on said stationary block, said rotary means having an axis of rotation coaxial with said central axis and driven by said second motor at a constant speed;

a second reduction die secured to said rotary means at a radially distal position from said axis of rotation, said rotary means drawing wire through said second reduction die as it coils wire on said stationary block; and means for regulating the speed of said rotary advancing block, comprising:

a tension control arm for sensing wire tension differentials between said rotary advancing block and said second reduction die, said tension control arm having a first end pivotally secured to said frame, and a second end opposite said first end having a sheave; and means for varying the speed of said first motor dependent on the position of said tension control arm, whereby constant wire tension may be maintained between said rotary advancing block and said second reduction die.

2. A machine for continuous wire drawing and collection as in claim 1, wherein said rotary advancing block has a horizontal axis of rotation.

3. A machine for continuous wire drawing and collection as in claim 1, wherein the central axis of said stationary block has a horizontal orientation.

4. A machine for continuous wire drawing and collection as in claim 1, wherein said rotary advancing block has a horizontal axis of rotation; and wherein the central axis of said stationary block has a horizontal orientation.

5. A machine for continuous wire drawing and collection as in claim 1, wherein said means for varying the speed of said first motor is a rheostat.

* * * * *